United States Patent [19]

Jacobson

[11] Patent Number: 4,493,358

[45] Date of Patent: Jan. 15, 1985

[54] APPARATUS AND METHOD FOR RETAINING PLEATS IN HANGING DRAPERIES

[76] Inventor: Jeff A. Jacobson, 22 Woodbgrove, Irvine, Calif. 92714

[21] Appl. No.: 255,332

[22] Filed: Apr. 17, 1981

[51] Int. Cl.[3] ..... A47H 13/14; F16G 11/00

[52] U.S. Cl. ..... 160/349 R; 160/348; 24/30.5 P; 24/115 R; 24/17 AP; 248/73; 248/74.4

[58] Field of Search ..... 160/348, 344, 349, 3-19; 24/17 AP, 115 G, 115 R, 132 R, 127, 132 AA, 115 A, 30.5 P, 30.5 S, 16 PB, 16 R, 339; 248/73, 74 PB

[56] References Cited

U.S. PATENT DOCUMENTS

| | | | |
|---|---|---|---|
| 3,116,784 | 1/1964 | Dwyer | 160/349 |
| 3,126,184 | 3/1964 | Kropp | 248/73 |
| 3,262,663 | 7/1966 | Jansson | 24/339 |
| 3,421,187 | 1/1969 | Ryder | 403/391 |
| 3,733,243 | 5/1973 | Crawford | 24/115 G |
| 3,819,139 | 6/1974 | Jemison | 24/339 |
| 3,834,824 | 9/1974 | Jahn | 24/16 PB |
| 3,874,034 | 4/1975 | Clayton | 24/30.5 P |
| 4,386,752 | 6/1983 | Pavlak | 248/73 |

FOREIGN PATENT DOCUMENTS

| | | | |
|---|---|---|---|
| 1654095 | 2/1971 | Fed. Rep. of Germany | 160/348 |
| 1056063 | 10/1953 | France | 24/17 A |
| 1529120 | 5/1968 | France | 24/30.5 P |

*Primary Examiner*—Peter M. Caun
*Assistant Examiner*—Cherney S. Lieberman
*Attorney, Agent, or Firm*—Louis J. Bovasso

[57] ABSTRACT

Apparatus and method for retaining pleats in hanging draperies including an elongated flexible cord having a plurality of elongated resilient members fixedly secured at spaced locations along the cord, each member including a first mating section interconnected by a fold portion to a second mating section and a pointed end extending from one of the mating sections. A pointed end receiver extends from the other of the mating sections in a direction opposite the pointed end whereby the two mating sections are releasably locked together with the pointed end entering the receiver clamping a portion of one of the pleats of the hanging drapery therebetween. In this manner, each resilient member is secured to a pleat thereby retaining the drapery in a hanging position spacing one pleat from another.

1 Claim, 4 Drawing Figures

APPARATUS AND METHOD FOR RETAINING PLEATS IN HANGING DRAPERIES

BACKGROUND OF THE INVENTION

1. Field of the Invention

The invention relates to an apparatus and method for retaining pleats in hanging draperies.

2. Description of the Prior Art

In making draperies, the drapery material is generally gathered and sewn at evenly spaced intervals along the top edge to form pleats. Such pleats form downwardly extending folds of substantially uniform shape when the drapes are installed. In the past, draperies were made of materials which hung in a manner in which it was desirable to maintain vertical pleats or folds in the hanging draperies. To augment the natural hang of the draperies, fold retaining means, such as disclosed in U.S. Pat. No. 3,116,785 to Dwyer, were used to form such folds. However, such means includes hook members which required sharp points to pierce the drapery material. This of course raises the cost of manufacture the resulted in sharp points injurious to the user, snagging of multiple pleats and tearing the fabric. In addition, the hooks slid on the string since they were not secured thereto. Finally, such hooks do not grasp the material in a positive manner and the pleats can work loose if the hooks lose resiliency.

The increased use of foam backed fabrics for insulation and energy related reasons result in the drapes which tend to flare at the bottom rather than maintaining the fabricated pleat formed at the top of the drapery which are held by hooks and slides. There is a need for such means for spacing pleats which is useful on any fabric, especially fiber glass and other unruly "no-iron" fabrics, because they cannot be trained into folds. All self-lined fabrics, sheers, and most other fabrics have this flaring problem as well. There is much need for means for spacing such pleats and maintaining spaced pleats vertically along the hanging drapes. Such means should be easily and inexpensively manufactured.

SUMMARY OF THE INVENTION

It is an object of this invention to provide improved means for retaining pleats in hanging draperies.

It is another object of this invention to provide such means which is easy to use, inexpensive to manufacture and can be made of differing materials and is reusable. It is still another object to provide such means which doesn't snag or slip on string or become unhooked.

These and other objects are preferably accomplished by providing an elongated flexible cord having a plurality of elongated resilient members fixedly secured at spaced locations along the cord, each member including a first mating section interconnected by a fold portion to a second mating section and a pointed end receiver extends from the other mating section in a direction opposite the pointed end whereby the two mating sections are releasably locked together with the pointed end entering the receiver clamping a portion of one of the pleats of the hanging drapery therebetween. In this manner, each resilient member is secured to a pleat thereby retaining the drapery in a hanging position spacing one pleat from another.

DESCRIPTION OF THE PREFERRED EMBODIMENT

Figures 1, 2, 3, 4:
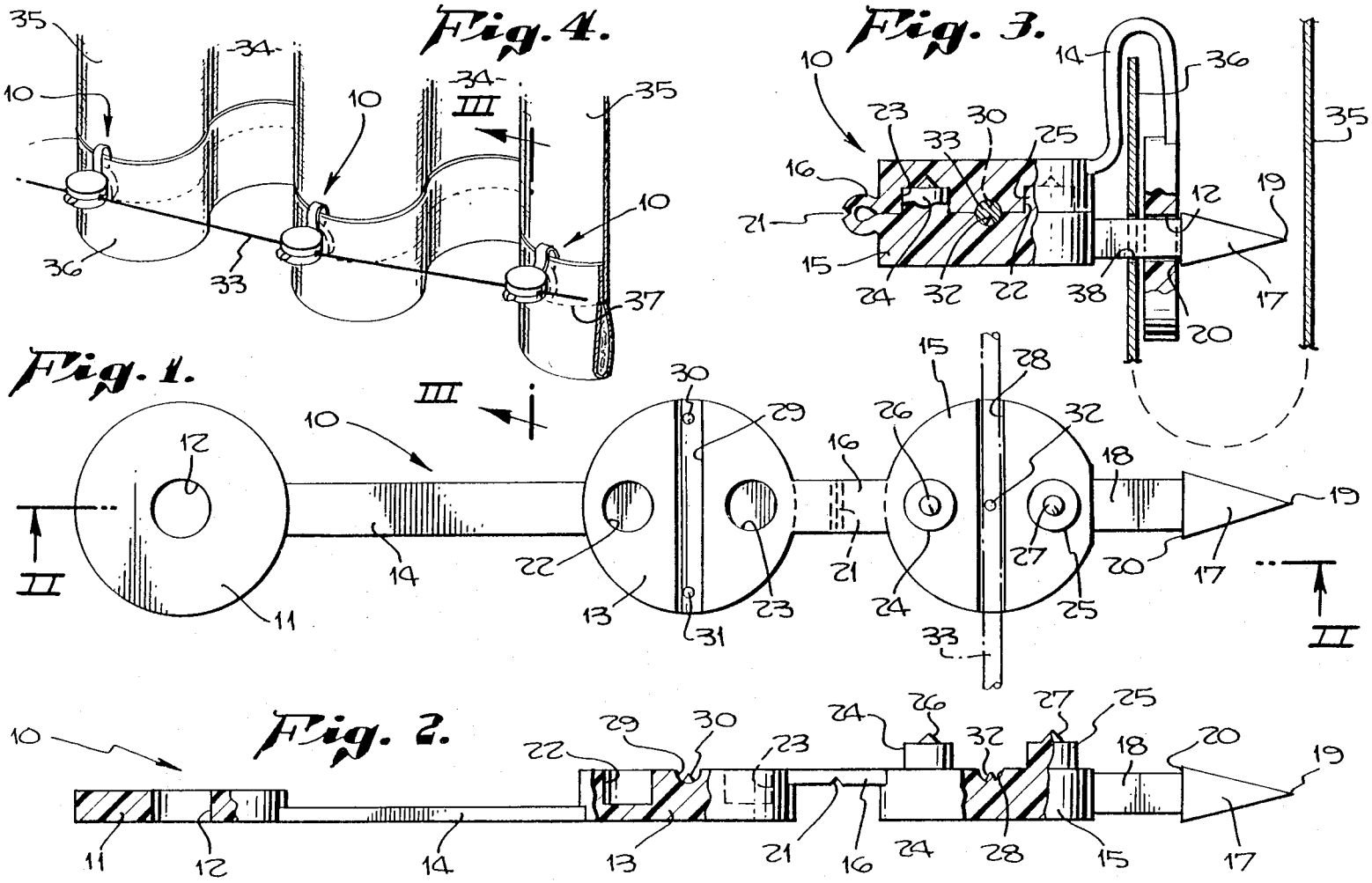
FIG. 1 is a top plan view of a fastener for use in retaining pleats in draperies in accordance with my invention.
FIG. 2 is a view taken along lines II—II of FIG. 1.
FIG. 3 is a detailed view of the fastener of FIGS. 1 and 2 showing the locking together of components thereof.
FIG. 4 is a perspective view of a plurality of fasteners connected to the cord of FIG. 3 installed on a hanging drapery.

Referring now to FIGS. 1 & 2 of the drawing, a fastener 10 is shown having a first generally circular pin receiving member 11, having a centrally located aperture 12 therein and a generally circular body member 13 interconnected to member 11 by a flexible elongated section 14. A generally circular body member 15, generally configured as member 13, is interconnected thereto by a flexible elongated member 16.

A tapered end 17 extends from and is integral with member 15, connected thereto by elongated member 18. Members 17 & 18 are essentially rigid, for reasons to be discussed, and end 17 includes a pointed tip 19 and a shoulder 20 at its intersection with member 18.

If desired, member 16 may include a cut-out portion 21 for facilitating bending of the same. The diameter of aperture 12 is related to a diameter along tapered end 17 so that end 17 can enter aperture 12.

Body members 13 & 15 are adapted to mate with one another and thus member 13 includes a pair of spaced generally circular cavities 22, 23 adapted to receive therein a pair of spaced protuberances 24, 25 on member 15. Each protuberance 24, 25 terminates in a pointed end 26, 27 respectively. The depth of cavities 22, 23 is slightly less than the overall length of each protuberance and its end.

A longitudinal groove 28 extends entirely through member 15 in a direction normal to the longitudinal axis of fastener 10. This groove 28 is adapted to mate with a like groove 29 formed in member 13 as will be discussed. A pair of spaced points 30, 31 are provided in groove 29 while a like point 32 is provided in groove 28. The actual number and spacing may vary.

As shown in FIG. 3, members 13 and 15 are folded about flexible members 16 with protuberances 24, 25 entering cavities 22, 23 in member 13. A flexible cord 33 is clamped between members 13, 15 in a circular opening formed by the mating of grooves 28, 29. Points 30 to 32 pierce cord 33 retaining cord 33 in the grooves 28, 29, as seen in FIG. 3, the cord 33 extends on both sides of members 13, 15 so that a plurality of fasteners 10 may be disposed along cord 33 at spaced locations.

The circular member 11 is of course secured to member 13 by section 14 and moved into a position whereby end 17 enters hole 12 in member 11. End 17 is pushed into hole 12 until shoulder 20 passes hole 12. Withdrawal of end 17 out of hole 12 is prevented by the engagement of shoulder 20 with the area surrounding hole 12.

Preferably, fastener 10 is made of suitable materials, such as high impact styrene or acrylic, nylon, acetal, rubber, rubberized acrylic, etc. In this way, the sections are resilient enough that end 17 can be easily withdrawn from hole 12 when desired.

The various sections may be any suitable dimensions or configurations other than those necessary to carry out the invention.

As shown in FIG. 4, a plurality of fasteners 10 are shown disposed along cord 33 entering folds or pleats 35 in drapery 34. The bottom of one of the pleats 35 is shown in FIG. 3. As can be seen, the material of drapery 34 is folded at the bottom up to form fold 36 with stitching 37 or the like retaining fold 36 in position. The tip 19 thus pierces the fabric material of fold 36 adjacent the top 38 and member 11 is folded about section 14 with end 17 entering hole 12 to secure the fabric of fold 36, as also shown in FIG. 3, between member 11 and mating members 13, 15. The cord 33 can be cut to any desired length depending on the width of the hanging drapery and the spacing desired between pleats of the drapery determines the distances between the plastic fastners welded ultra sonically along the cord. Various spacings will be manufactured. A positive firm lock is provided and can be easily removed by pushing end 17 back through hole 12.

It can be seen that I have disclosed apparatus and method for retaining pleats in hanging draperies in a safe, economical and improved manner.

With the apparatus and method disclosed herein, the drapery industry can use fabrics that, in the past, did not hang properly. The invention herein assists in energy saving since foam backed fabrics can be used to provide insulation, which fabrics didn't hang right in the past. Use of the apparatus and method disclosed herein avoids drapery installers from having to make house calls to correct the problem of drapes that do not hang properly since this is easily taken care of when installed.

I claim:

1. Apparatus for maintaining a plurality of pleats formed in a hanging drapery hanging from a drapery rod or the like a predetermined distance apart, each of said pleats having a portion folded up from the bottom of said drapery having a hem comprising:

an elongated resilient cord extending along substantially the bottom of said pleats generally normally to the longitudinal axis of said pleats and generally parallel to the drapery rod from which the drapery hangs;

a plurality of fasteners coupled to both said cord and successive ones of said pleats at spaced locations along said cord, each of said fasteners including a generally circular pin receiving member having an aperture therethrough, an elongated first flexible member inter-connecting said pin receiving member to a generally circular first body member, said first body member having a shallow groove extending across the face thereof in a direction generally normal to the longitudinal axis of said first flexible member, at least one cord piercing element disposed in said groove, at least one protuberance receiving cavity also disposed in said first body member, an elongated second flexible member interconnecting said first body member to a second generally circular body member, said second elongated flexible member having its longitudinal axis coincident with the longitudinal axis of said first flexible member and being substantially shorter in length than said first flexible member, said second body member also having a shallow groove extending across the face thereof in a direction generally normal to the longitudinal axes of said first and second elongated flexible members, said last mentioned shallow groove also having at least one cord piercing element therein, and said second body member having at least one protuberance of a configuration generally the same as said protuberance receiving cavity and receivable therein when the face of said first and second body members are brought together by folding of said second flexible memeber, the depth of said cavity being generally related to the thickness of said protuberance and adapted to releasably snap together so that, when brought together by folding, said first and second body members form a cord holding body with said faces abutting against each other and said grooves aligning with each other, an elongated substantially rigid member extending from said second body member having its longitudinal axis essentially coincident with the longitudinal axes of said first and second elongated flexible members, said rigid member terminating in a generally rigid sharp point having a generally triangular cross-section with the apex thereof extending away from said rigid member and the base thereof being adjacent said rigid member having a width greater than the width of said rigid member thereby forming a shoulder, each of said first flexible members being folded over the top of each hem of said successive pleat so that each of said pin receiving members is disposed between the inside of the fold of said pleat and said drapery, each said fastener being folded about said second flexible member with said faces abutting against each other and said protuberance entering said cavity, said elongated resilient cord being disposed in said aligned grooves with said elements piercing said cord, the overall diameter of said aligned grooves being generally the same as the diameter of said cord, said sharp point piercing the fold hem of each of said pleats from the outside of said fold to the inside thereof and passing through said apertures in each of said pin receiving members, said shoulder abutting against the furthest side of said pin receiving member to retain said sharp point through said aperture yet permitting said sharp point to be removed from said aperture by pushing it in a reversed direction out of said aperture, the resilience of said pin receiving member permitting the same so that each of said fasteners are removably secured to successive pleats and each of said fasteners can be relocated along said cord to change the depth of said pleats.

* * * * *